US009352946B2

(12) United States Patent
Robinson, III

(10) Patent No.: US 9,352,946 B2
(45) Date of Patent: May 31, 2016

(54) UNIVERSAL BOTTLE AND JAR OPENER

(71) Applicant: Samuel Truby Robinson, III, Santa Barbara, CA (US)

(72) Inventor: Samuel Truby Robinson, III, Santa Barbara, CA (US)

( * ) Notice: Subject to any disclaimer, the term of this patent is extended or adjusted under 35 U.S.C. 154(b) by 250 days.

(21) Appl. No.: 14/179,444

(22) Filed: Feb. 12, 2014

(65) Prior Publication Data

US 2014/0338499 A1 Nov. 20, 2014

Related U.S. Application Data

(60) Provisional application No. 61/763,547, filed on Feb. 12, 2013.

(51) Int. Cl.

| | |
|---|---|
| ***B67B 7/18*** | (2006.01) |
| ***B67B 7/20*** | (2006.01) |
| ***B67B 7/16*** | (2006.01) |
| ***B67B 7/00*** | (2006.01) |

(52) U.S. Cl.
CPC .... *B67B 7/18* (2013.01); *B67B 7/16* (2013.01)

(58) Field of Classification Search
CPC ..... B67B 7/16; B67B 7/18
See application file for complete search history.

(56) References Cited

U.S. PATENT DOCUMENTS

| | | | | | |
|---|---|---|---|---|---|
| 1,954,422 | A * | 4/1934 | McIntyre | B67B 3/2006 | 279/102 |
| 1,960,531 | A * | 5/1934 | Driscoll | B67B 3/2006 | 279/102 |
| 2,761,337 | A * | 9/1956 | Daniel | B67B 7/18 | 81/3.25 |
| 3,604,290 | A * | 9/1971 | Waite | B67B 7/182 | 81/3.4 |
| 4,001,904 | A * | 1/1977 | Gill | B67B 7/18 | 15/229.13 |
| 4,662,250 | A * | 5/1987 | Kee | B67B 7/18 | 81/3.25 |
| 4,702,129 | A * | 10/1987 | Allen | B67B 7/18 | 81/3.09 |
| 4,766,781 | A * | 8/1988 | Grise | B67B 7/18 | 81/3.4 |
| 5,784,933 | A * | 7/1998 | Persellin | B67B 7/18 | 81/3.36 |
| 5,836,221 | A * | 11/1998 | Hystead | B67B 7/18 | 81/3.25 |

* cited by examiner

*Primary Examiner* — David B Thomas
(74) *Attorney, Agent, or Firm* — Schmeiser, Olsen & Watts LLP

(57) ABSTRACT

A lid opener is provided. The lid opener includes a solid body piece having a first end, the solid body piece being adapted to flex. The solid body piece can further include an annulus defined in the first end, with the annulus defining a gradually diminishing diameter from the first end. The annulus is configured to be inserted over and functionally engage a lid of a container to facilitate the removal of the lid from the container.

1 Claim, 11 Drawing Sheets

UNIVERSAL BOTTLE AND JAR OPENER

CROSS REFERENCE TO RELATED APPLICATION

This application claims priority to U.S. Provisional Patent Application to Robinson entitled "UNIVERSAL BOTTLE AND JAR OPENER," Ser. No. 61/763,547, filed Feb. 12, 2013, the disclosure of which is hereby incorporated entirely herein by reference.

BACKGROUND

1. Technical Field

This disclosure relates generally to bottle and jar openers, and in particular to a device that can conform to jar lids of varying diameters to assist in the removal of the lid. The device may also comprise a built in bottle opener.

2. State of the Art

Jar and bottle lid openers have long been known in the art. A jar opener can be used to increase the friction between the opener's hand and the jar lid. This is frequently done by placing an object between the jar lid and the user's hand. Using such devices between the user's hand and the jar lid allows more torque to be transmitted from the user's hand to the jar lid. However, jars having relatively small lids such as nail polish, paint tubes, or kitchen spices, are difficult to grip with a conventional opener. And because of their small size, they can generally be twisted by the user's fingers only. And most users' fingers are not strong enough to twist a small bottle cap that is affixed tightly to the bottle.

Thus, it would be useful to have a bottle opener that could open a wide variety of sizes and shapes of jar lids and bottle caps such as nail polish, tubes of glue, tubes of paint, toothpaste, cake decorating icing, putties and fillers and any other type of jar that has a screw on lid.

SUMMARY

The present disclosure relates to bottle and jar openers, and in particular to a device with a relatively high coefficient of friction that can conform to jar lids of varying diameters to assist in the removal of the jar lid from the jar body. The device may also comprise a built in bottle opener. The present disclosure relates generally to a device that can open jar lids of a wide variety of sizes by being sized to accommodate lids from relatively large to relatively small dimensions while providing a large gripping surface to increase the amount of friction and torque the user can apply to the jar lid.

An aspect of the present disclosure includes a lid opener comprising a solid body piece having a first end, the solid body piece being adapted to flex, an annulus defined in the first end of the solid body piece, the annulus defining a gradually diminishing diameter from the first end, and wherein the annulus is configured to be inserted over and functionally engage a lid of a container to facilitate the removal of the lid from the container.

Another aspect of the present disclosure includes a lid opener comprising a solid body piece having a first end and a second end, the solid body piece being adapted to flex, a first annulus defined in the first end of the solid body piece, the first annulus defining a tapered surface from the first end, a second annulus defined in the second end of the solid body piece, the second annulus defining a tapered surface from the second end, the tapered surface from the second end having a greater taper than the tapered surface of the second end, and wherein the first and second annulus are configured to be inserted over and functionally engage a lid of a container to facilitate the removal of the lid from the container.

Another aspect of the present disclosure includes the device being made from rubber or other material with a high degree of surface friction and designed such that the bottle cap can be inserted into the appropriately sized end of the opener. When pressure is applied, the resulting friction allows the cap to break loose from the bottle and open. The elasticity of the rubber material also results in increased pressure via a pinching/clamping action that increases the friction applied to the cap allowing easier removal. One end may have an inner diameter sized for taller caps while the other is for shorter caps. It would be useful if the inner diameter sized for taller caps comprised a long and gradual taper so as to provide the maximal area of the inside surface of the opener to contact the cap, so as to provide the maximum amount of friction to be applied to the cap.

It would also be useful if the device also comprised bottle openers. These can take the form of a rigid structure that possesses an edge that can catch the edge of the bottle cap and a pivot point that allows the user to pry the bottle cap from the bottle, or they can take the form of a cavity in the outer surface of the device sized and shaped to engage a twist off type bottle cap such that the twist off type bottle cap can be inserted into the cavity and removed by twisting the device.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

Unless defined otherwise, all technical and scientific terms used herein have the same meaning as commonly understood to one of ordinary skill in the art to which this disclosure belongs. Although any methods, devices or materials similar or equivalent to those described herein can be used in the practice or testing of the disclosure, the disclosed methods, devices, and materials are now described.

As a preface to the detailed description, it should be noted that, as used in this specification and the appended claims, the singular forms "a", "an" and "the" include plural referents, unless the context clearly dictates otherwise.

Figure 1:
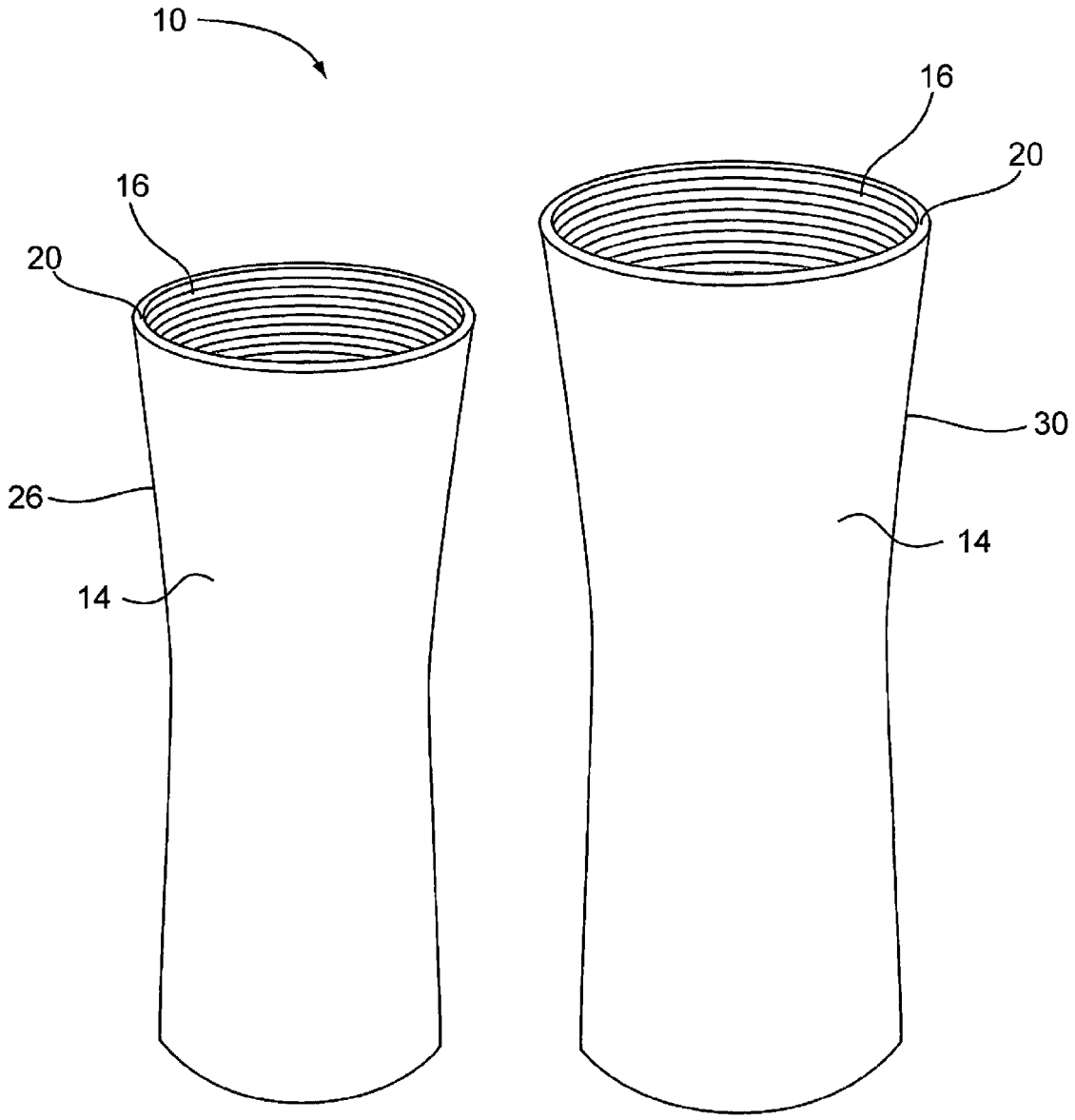
FIG. 1 is a perspective view of one or more embodiments of a jar and bottle opener in accordance with the present disclosure.

Referring to the drawings, FIG. 1 depicts embodiments of a lid opener 10. Embodiments of the lid opener 10 may comprise various structural and functional components that complement one another to provide the unique functionality and performance of the lid opener 10, the structure and function of which will be described in greater detail herein.

In accordance with an embodiment of the opener 10, FIG. 1 depicts two embodiments of lid openers 10. Embodiments of the opener 10 may further comprise a solid piece 14, or a lid opener body, that may contain an annulus 16. The annulus 16 may be a circular annulus, but may additionally be a size and shape sufficient to engage a bottle or jar lid. As such, oval, triangle, rectangle, square, or other similar shapes may be utilized. Under the condition the annulus 16 is circular in shape, the cross-sectional diameter of the annulus may vary along its length. The diameter of the annulus 16 may be the greatest/largest at its first end 20 and may become progressively smaller moving away from the first end 20. Such a configuration provides the advantage that the opener 10 may accommodate lids of varying sizes. For example, the lid to be opened may be inserted into the opener 10 until it reaches a point in the annulus 16 where the diameter of the annulus 16 matches the outside diameter of the lid, such that the annulus 16 functionally engages the outside of the lid. The user may then exert a steady downward pressure on the opener 10 while simultaneously twisting the opener 10 until the lid or cap breaks loose from the jar or bottle and begins to turn.

Embodiments of the opener 10 may comprise the annulus 16 extending partially through the solid piece 14 from the end 20. Embodiments of the opener 10 may comprise the annulus 16 extending all the way through the solid piece 14 from the end 20 to an opposing end 21. Embodiments of the opener 10 may comprise the annulus 16 having the greatest diameter closest to the end 20 of the solid piece 14 with the diameter becoming progressively smaller as the annulus 16 moves away from the end 20. The rate of change in diameter of the annulus 16 may be different from one opener 10 to another opener 10. For example, as depicted in FIG. 1, first opener 26 comprises an annulus 16 exhibiting a more rapid reduction in the diameter of the annulus 16 as it moves away from end 20 than does the annulus 16 of the second opener 30. As such, the annulus 16 of the second opener 30 exhibits a more gradual taper than that of the annulus 16 of the first opener 26. Embodiments of the opener 10 thus accommodate a wider range of sizes of jar lids and bottle caps such as nail polish, tubes of glue, tubes of paint, toothpaste, cake decorating icing, putties and fillers and any other type of jar that has a screw on lid.

Embodiments of the opener 10 may comprise the annulus 16 being comprised of rubber or other flexible material that may possess or exhibit a high coefficient of friction, such as above $1.0\mu_s$, while the annulus 16 engages the lid of the bottle or jar. The solid piece 14 may also comprise rubber or other flexible material possessing a high coefficient of friction, such as above $1.0\mu_s$, while the solid piece 14 engages the lid of the bottle or jar. The solid piece 14 and the annulus 16 may be configured to be flexible so as to be bent in the user's palm or fingers. The solid piece 14 may be sized and shaped to be easily gripped by the average hand so as to allow the maximum amount of force and torque to be applied to the lid. Such a configuration provides the advantage that the user may transmit the maximum amount of torque from the user' had to jar lid through manipulation of the opener 10 and the relatively high coefficient of friction between the opener 10 and the lid.

Embodiments of the opener 10 may comprise the solid piece 14 being surrounded, encased, enclosed, sustained, reinforced, bounded, or otherwise supported by a hard or rigid material 15 in, on, or around the exterior surfaces of the solid piece 14, the hard or rigid material 15 being materials such as hardened plastic or a metal. Hard material 15 may be configured to be an outside surface, or exterior surface, of the solid piece 14 to provide additional structural integrity to the opener 10 and to prevent the opener 10 from deforming as it is pressed down onto the jar lid. Thus the hard material 15 may provide that great pressure can be applied to the opener 10 without distorting the shape of the annulus 16 therein.

Figure 2:
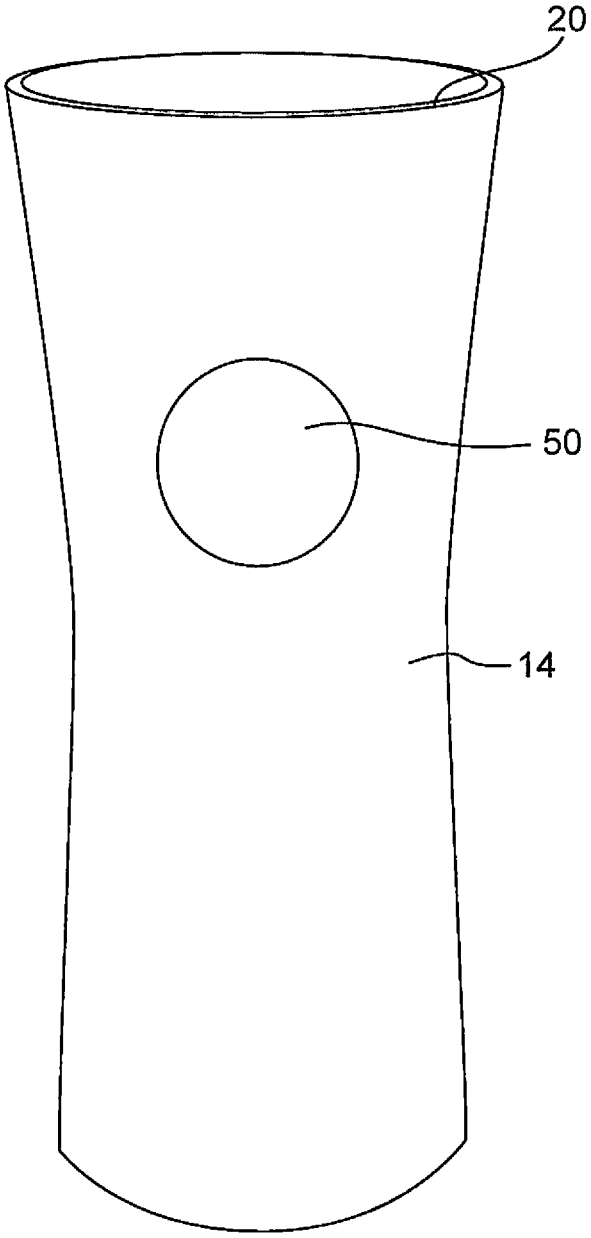
FIG. 2 is a perspective view of an embodiment of a jar and bottle opener having a bottle cap opener feature in a side portion thereof, in accordance with the present disclosure.
Figure 3:
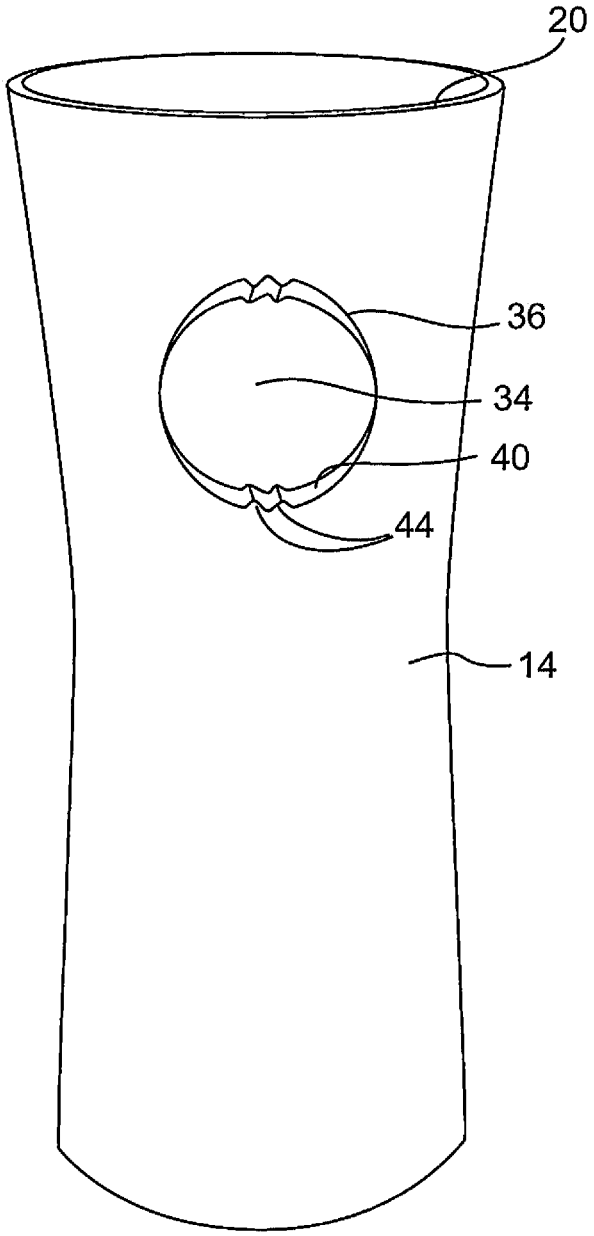
FIG. 3 is a perspective view of an embodiment of a jar and bottle opener having a bottle cap twist opener feature in a side portion thereof, in accordance with the present disclosure.

Embodiments of the opener 10 may comprise the hard outer covering 15 being also comprised of one or more engagement members 33, such as an opening 50 or a cutout 36. For example, as depicted in FIG. 2, the opening 50 is sized and shaped to serve as a bottle opener for pry twist off type bottle caps. Further in example, FIG. 3 depicts an opener 10 with the cutout 36 sized and shaped to act as an opener 10 for twist off type bottle caps. The inside surface 40, such as an edge surface, of the cutout 36 may define a radius of sufficient diameter to accommodate a standard sized bottle cap. The inside surface 40 may comprise surface feature 44, such as serrations, that may be configured to functionally engage the serrated edge of the conventional bottle cap. The external engagement members 33 may be placed in such a way on the exterior surfaces of the opener 10 so as to allow increased leverage during the opening action, both twisting and levering. A face 34 of the openers 10 may be used additionally for product branding by a multitude of businesses as is depicted in FIG. 3. The face 34 may be within the cutout 36 or may alternatively be positioned on the exterior surface of the hard or rigid covering 15.

Figure 11:
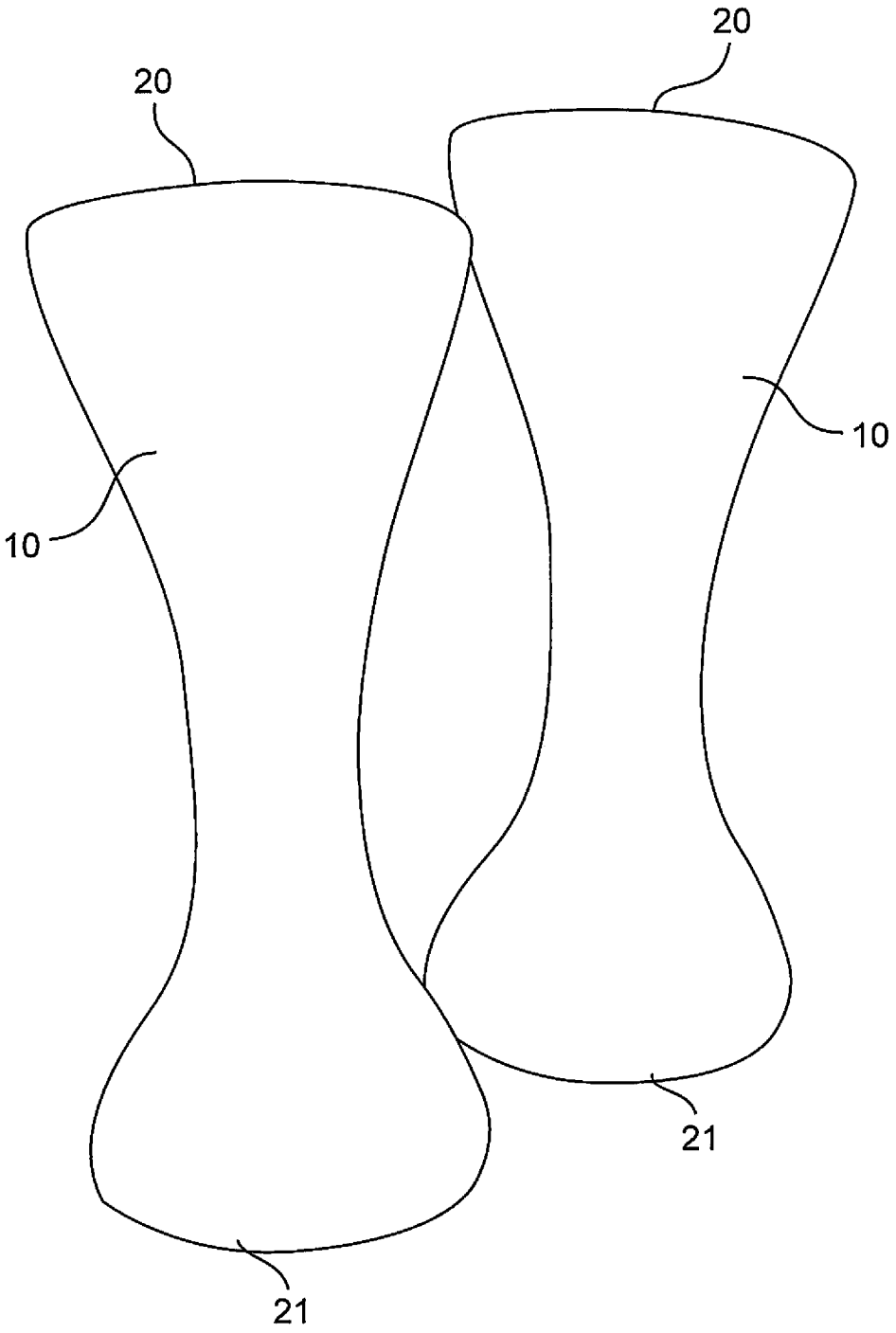
FIG. 11 is a side view of embodiments of the opener in accordance with the present disclosure.

Embodiments of the opener 10 may further comprise the opener 10 being configured to fit comfortably in most people's hands while minimizing weight and material. Thus, embodiments of the opener 10 may comprise a generally concave exterior shape with ends 20 and 21 having a larger cross-sectional diameter than the cross sectional diameter of the portions of the opener 10 positioned between opposing ends 20 and 21, as depicted in FIG. 11. Moreover, the smallest cross-sectional diameter of the opener 10 may not be positioned at the midpoint of the opener 10, but may be positioned on a side of the midpoint, as exemplarily depicted in FIG. 11. In addition to a concave shape, embodiments of the opener 10 may further comprise the opener 10 having a square or rectangular exterior shape, or defining any type of polygonal shape. The outside surface could also be textured in a variety of ways (knurled, digital, football skin, wavy, etc., as well as customized to mimic a particular item such as a wine bottle, soda bottle, or Disney® character, such as Mickey Mouse.

Figure 4:
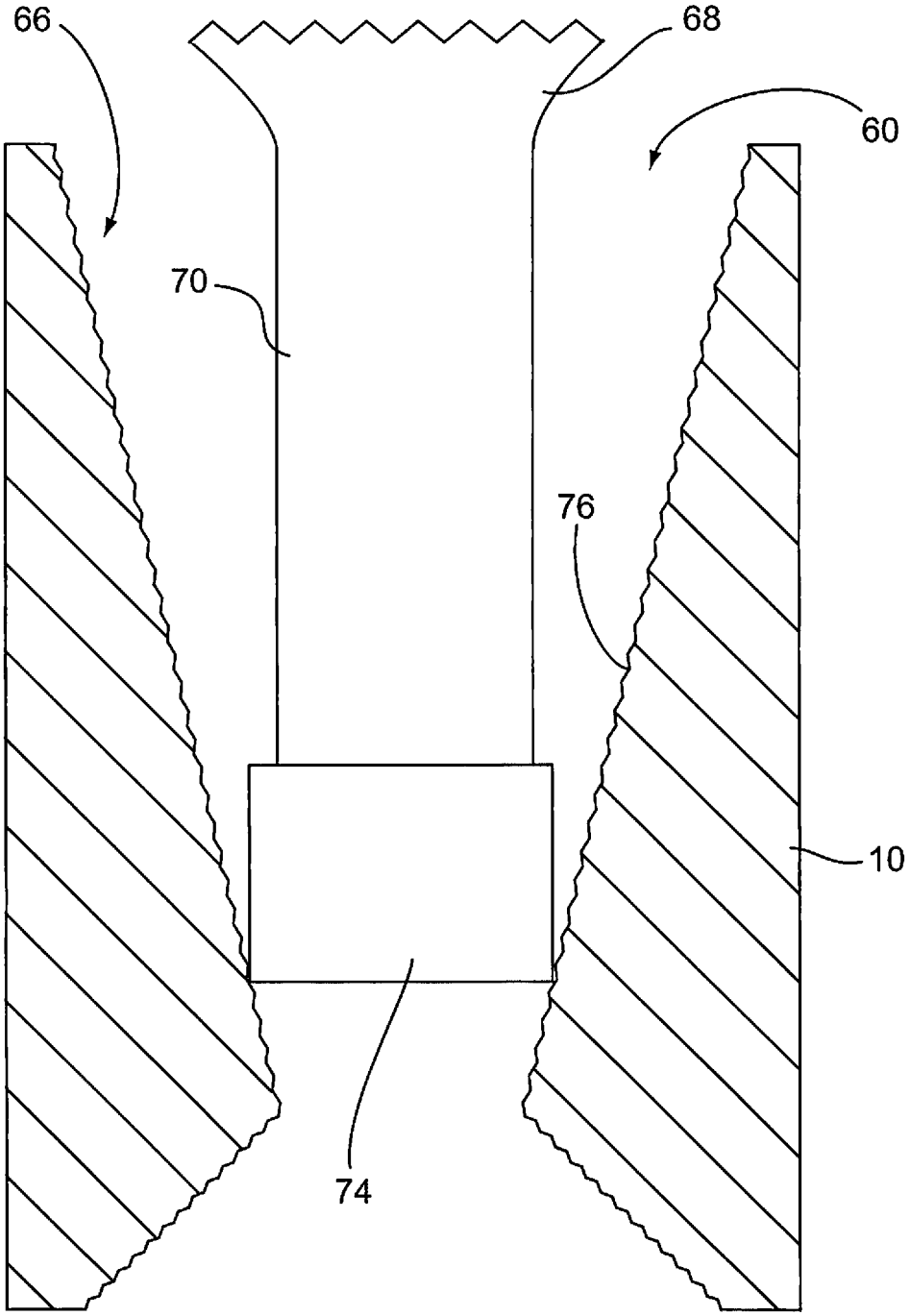
FIG. 4 is a cross-sectional side view of an embodiment of the opener, the opener engaging a bottle with a long neck and a bottle cap thereon, in accordance with the present disclosure.

With reference to FIG. 4, embodiments of the opener 10 may further comprise a first opening 60 and a second opening 64. The first opening 60 comprises a relatively gradual taper to the annulus 66 when compared to the second opening 64. A bottle 68 with a long neck 70 may be inserted into the annulus 66 through the first opening 60 until the cap 74 and the interior surface 76 of the annulus 66 achieve functional engagement. Because of the gradual taper, more of the surface area of the interior surface 76 of the annulus 66 may contact the cap, creating a greater amount of friction between the opener 10 and the cap 74.

Figure 5:
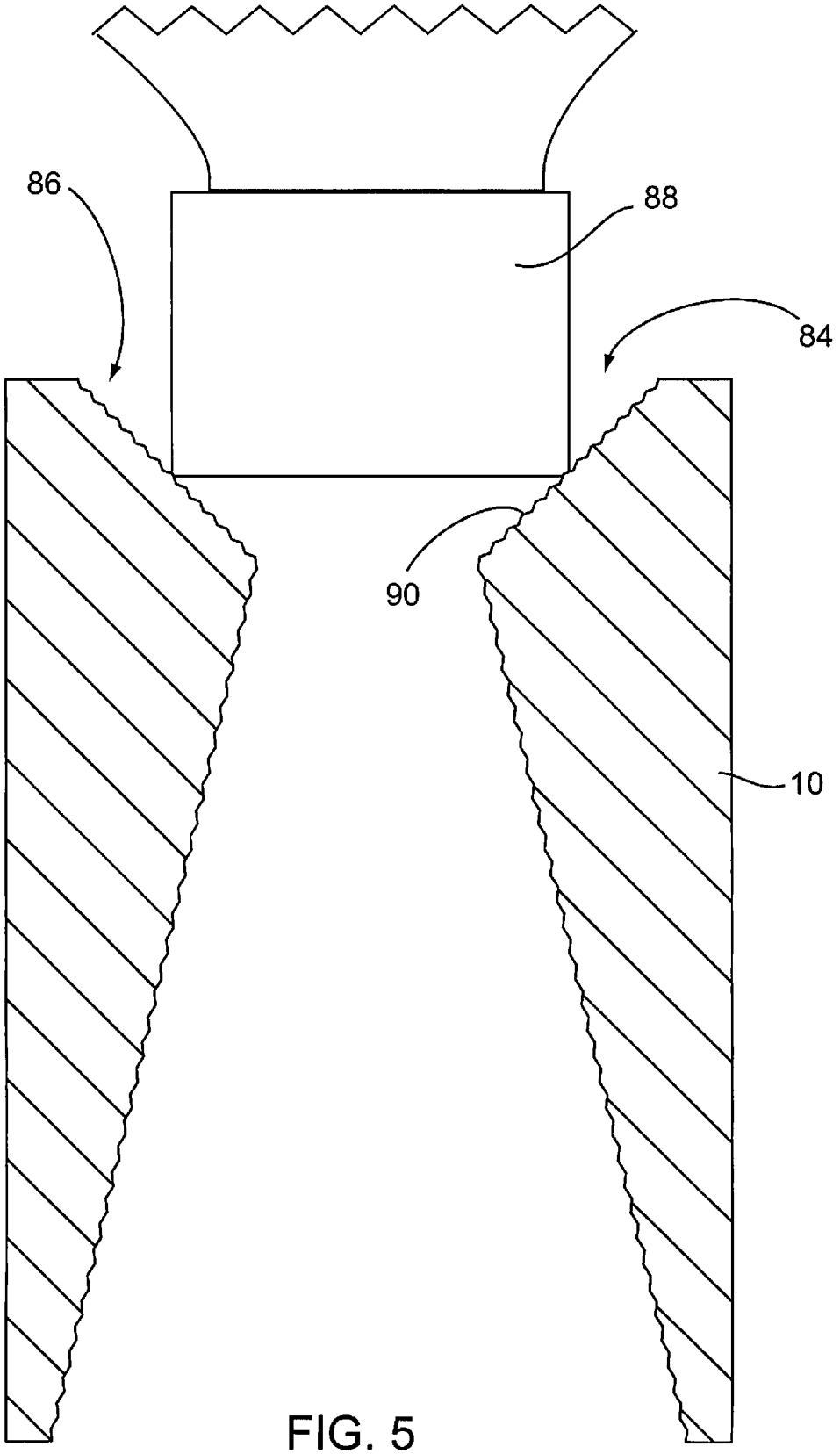
FIG. 5 is a cross-sectional side view of an embodiment of the opener, the opener engaging a bottle with a short neck and a bottle cap thereon, in accordance with the present disclosure.

With reference to FIG. 5, embodiments of the opener 10 may further comprise a first opening 80 and a second opening 84. The second opening 84 defines an annulus 86 having a relatively rapid taper when compared to the annulus defined by the first opening 80. A bottle cap may be inserted into the second opening 84 until functional engagement is achieved between the cap 88 and the interior surface 90 of the annulus 86.

Figure 6:
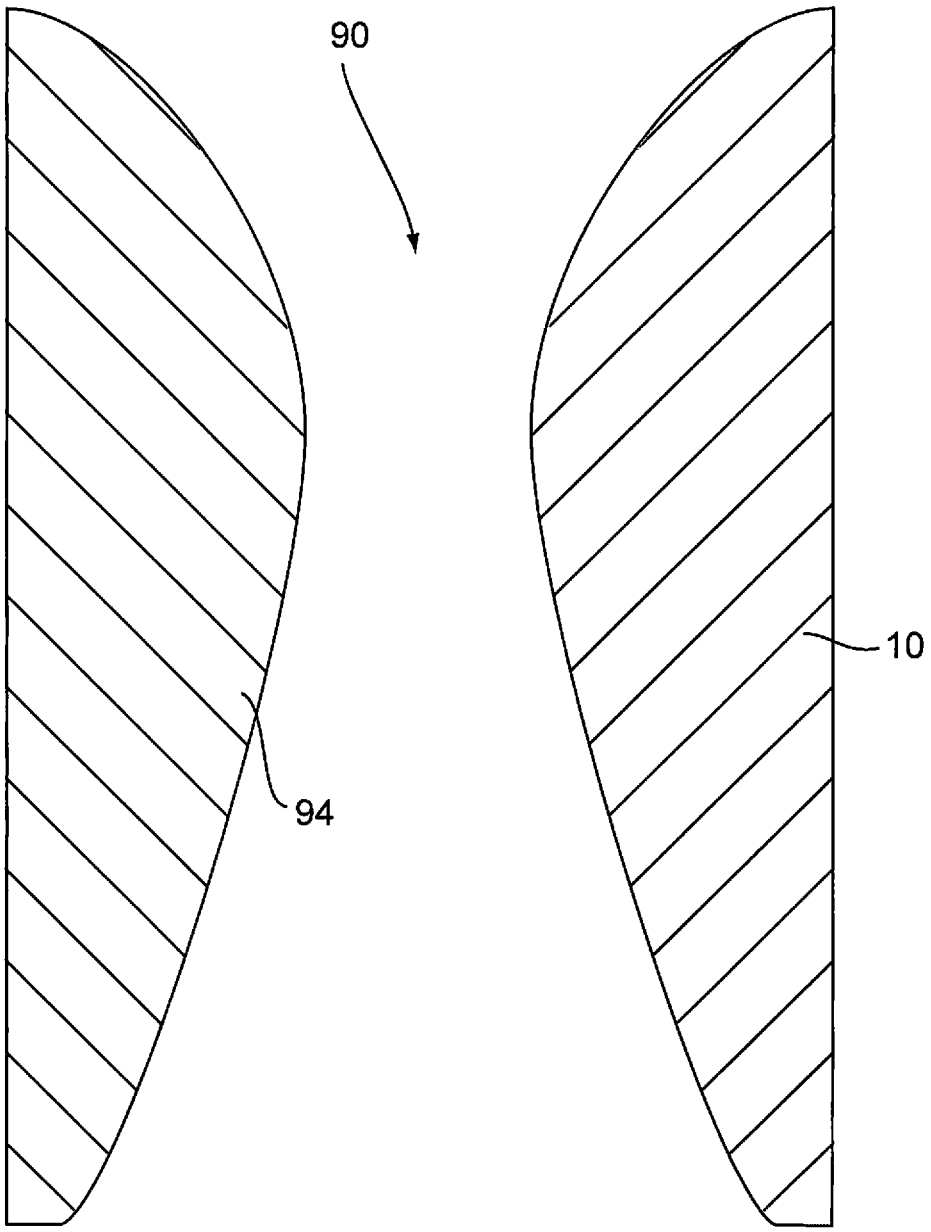
FIG. 6 is a cross-sectional side view of an embodiment of the opener in accordance with the present disclosure.

With reference to FIG. 6, embodiments of the opener 10 may further comprise an annulus 90 with a smooth surface 94. In this embodiment, the interior surface 94 describes a generally parabolic shape.

Figure 7:
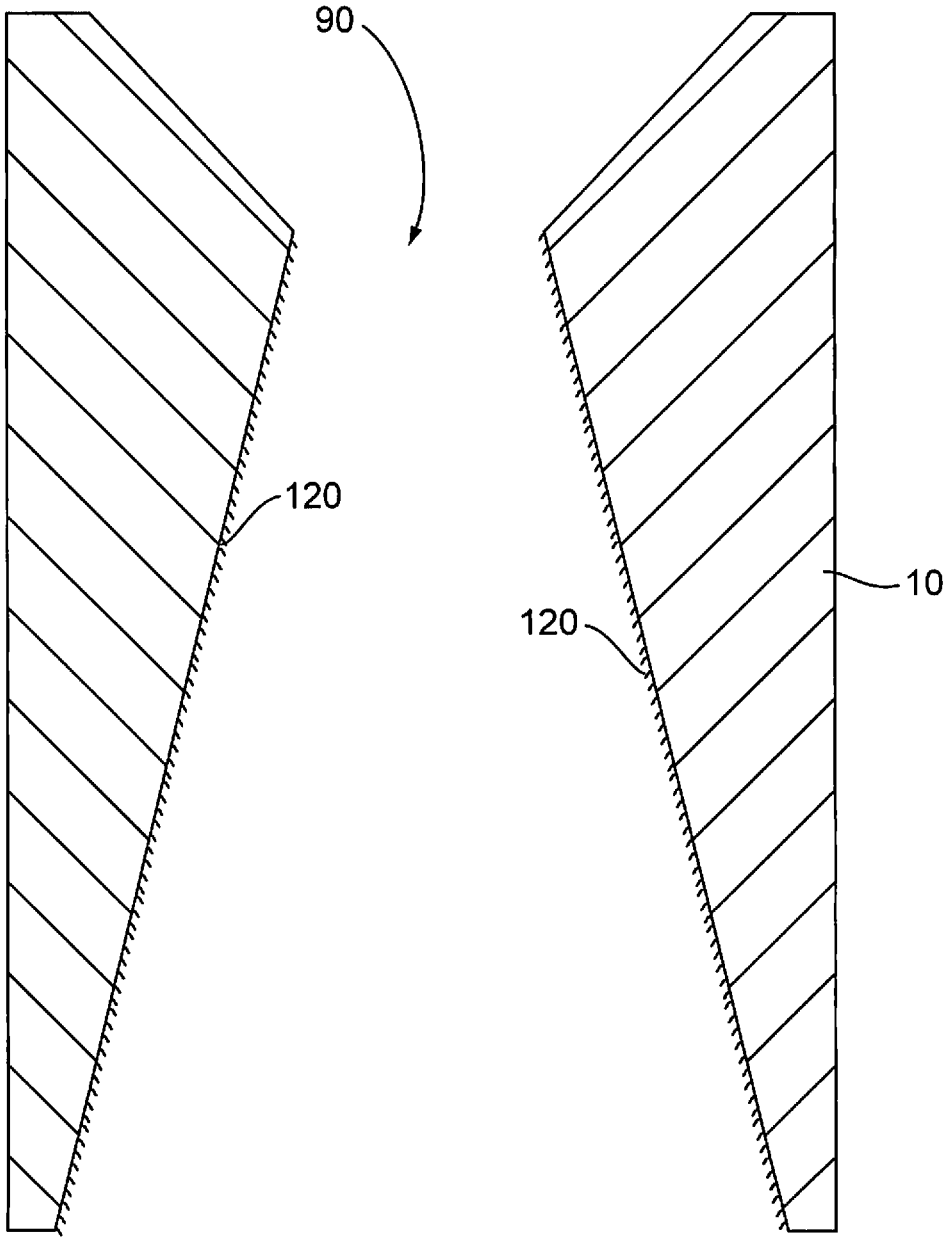
FIG. 7 is a cross-sectional side view of an embodiment of the opener in accordance with the present disclosure.

With reference to FIG. 7, embodiments of the opener 10 may further comprise an annulus 90 and wherein the surface of the annulus 90 comprises micro fibers 120. These micro fibers 120 are generally 1.3 deniers or finer. The micro fibers 120 are located and arranged such as to increase the ability of the opener 10 to grip the jar lids.

Figure 8:
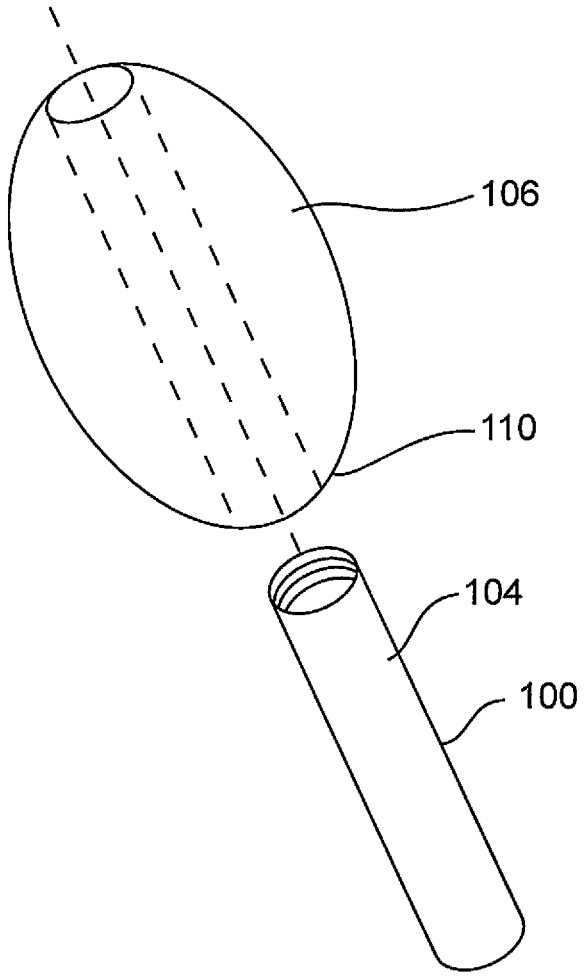
FIG. 8 is an exploded view of an embodiment of the opener being paired with a custom exterior, in accordance with the present disclosure.

With reference to FIG. 8, embodiments of the opener 10 may further comprise the opener 10 having more or less a straight or flat outer or exterior surface 104, such as that of a tube or cylinder. Such a configuration provides that the opener 100 may be inserted into a separate outer shell 106, or casing, via an annulus 110 in the outer shell 106 sized and shaped to accept the opener 100.

Embodiments of the opener 10 may further comprise the opener 10 being open only at one end. The other end may comprise a knob or other protrusion sized and shaped to fit comfortably into the palm of the user's hand. This embodiment is calculated to maximize the amount of downward force as well as torque that can be applied to the cap to be removed.

Embodiments of the opener 10 may further comprise the opener 10 being customized to act as a multipurpose tool for certain types of tasks related to a particular type of bottle. In one embodiment, the sides of the opener 10 may comprise longitudinal grooves into which are inserted emery hoards such that the opener 10 can be used to open nail polish bottles and to assist in painting and manicuring fingernails.

Figure 9:
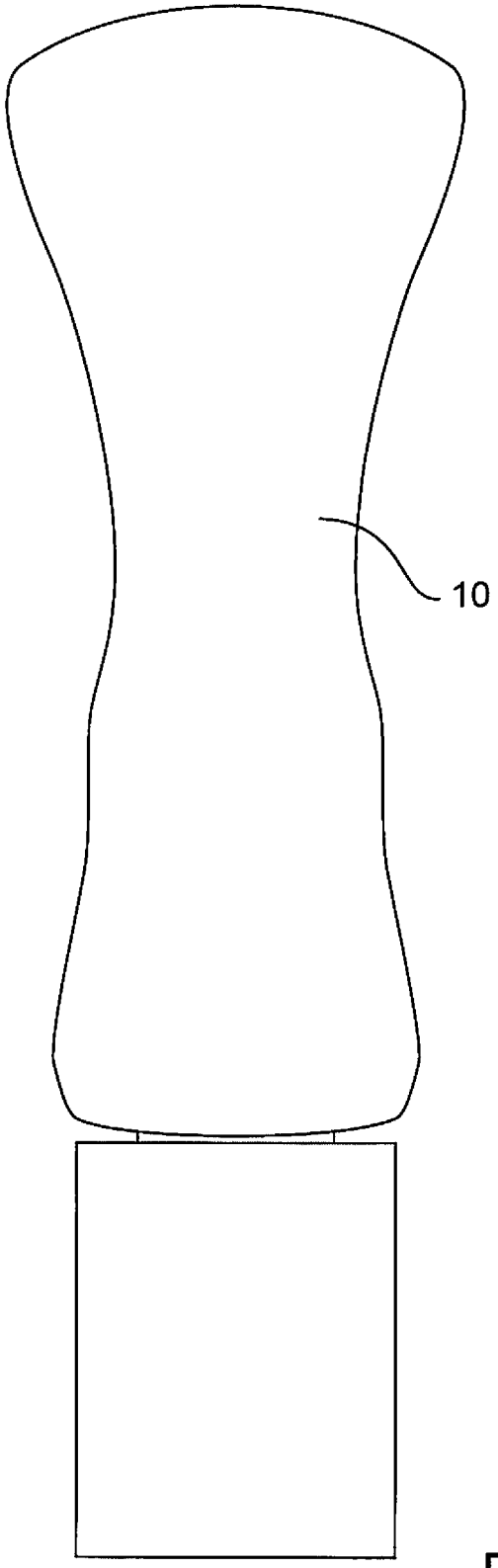
FIG. 9 is a side view of an embodiment of the opener being functionally engaged with a lid of a container, in accordance with the present disclosure.
Figure 10:
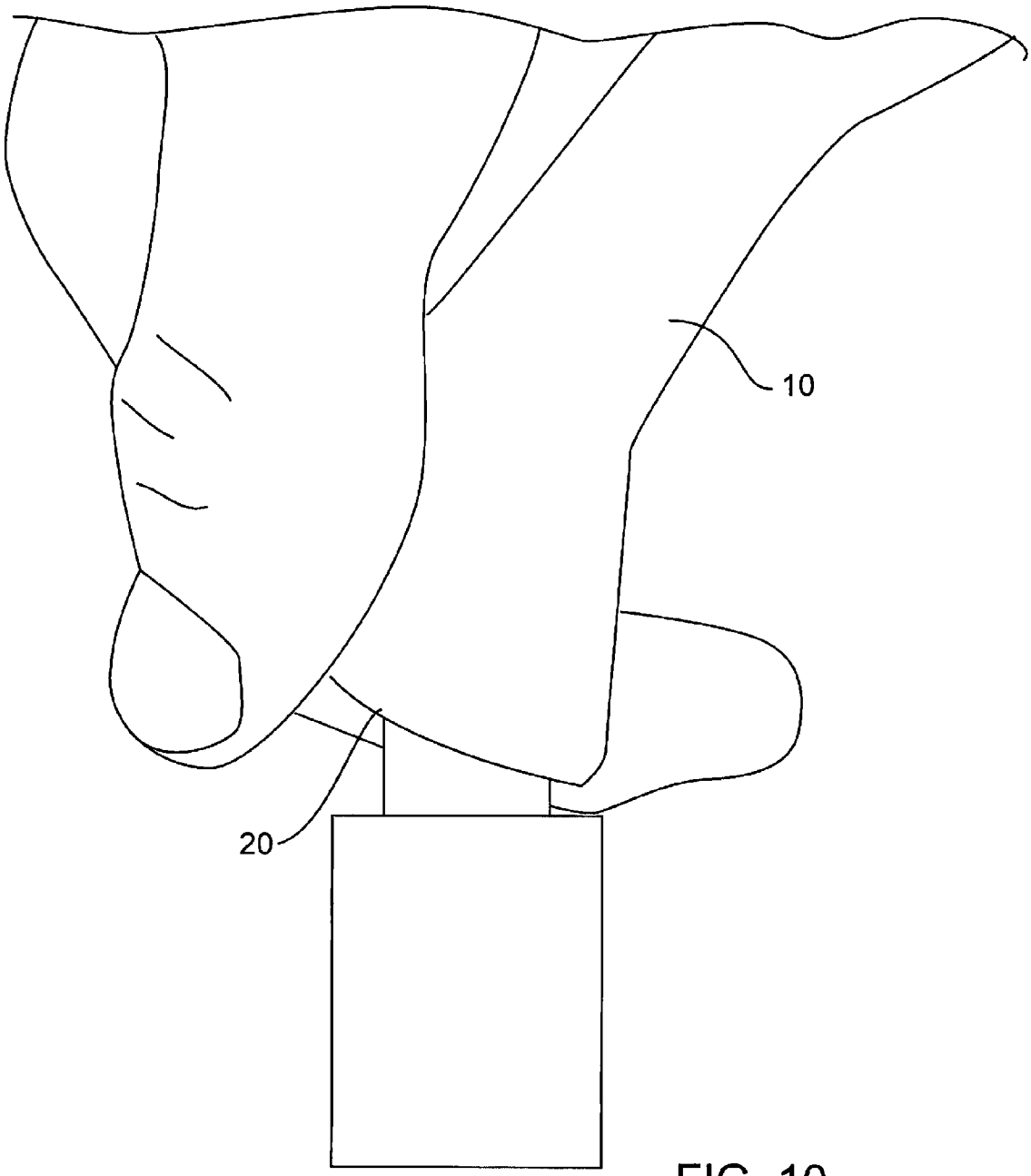
FIG. 10 is a side view of an embodiment of the opener being functionally engaged with a lid of a container, in accordance with the present disclosure.

Embodiments of the opener 10 may further comprise the opener 10 comprising all rubber, or other flexible material, so that the opener 10 may bend, flex, twist, bow, or otherwise move in response to forces exerted thereon. For example, as depicted in FIGS. 9 and 10, the opener 10 may bend or flex to be inserted over the cap of the bottle (FIG. 9) or in response to forces exerted by the user (FIG. 10).

Embodiments of the opener 10 may further comprise the exterior surfaces of the opener 10 being configured to bend and flex so as to be pressed against the bottle cap to grip the bottle cap to effectuate efficient removal of the bottle cap from the bottle. Further in example, the opener 10 may be bent so that the exterior surfaces of the opener 10 may be wrapped around the circumference of the bottle cap and thereafter squeezed against the bottle cap to allow the exterior surfaces to grip the bottle cap to effectuate efficient removal of the bottle cap from the bottle.

Embodiments of the opener 10 may further comprise the first end 20 being configured to be folded over itself a length of the opener 10. In this way, the smaller dimensions of the annulus 16 revealed by the first end 20 being peeled back on itself may be further exposed to engage smaller sized bottle caps. Moreover, with the first end 20 being folded over itself, more material of the solid piece 14 (i.e., double the material) is positioned between the user's hand and the bottle cap to provide better grip of the bottle cap with the opener 10 in the user's hand.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A lid opener comprising:

a unitary body piece having a first end and a second end, the unitary body piece formed of flexible material, wherein the unitary body piece bends, flexes, twists, bows, or otherwise moves in response to forces exerted thereon;

a first annulus defined in the first end of the unitary body piece, the first annulus defining a tapered surface from the first end;

a second annulus defined in the second end of the unitary body piece, the second annulus defining a tapered surface from the second end, the tapered surface from the second end having a greater taper than the tapered surface of the first end, the first and second annulus forming an opening extending through the unitary body piece; and wherein one of the first annulus or second annulus are configured to be inserted over and functionally engage a lid of a container to facilitate the removal of the lid from the container; and wherein the first end is foldable over itself a length of the unitary body piece to reveal and provide access to smaller dimensions of the first annulus to engage smaller sized bottle caps.

* * * * *